US006514368B1

(12) United States Patent
Holtslag et al.

(10) Patent No.: US 6,514,368 B1
(45) Date of Patent: Feb. 4, 2003

(54) METHOD FOR THE PRODUCTION OF A SANDWICH PANEL AND CORE MATERIAL THEREFOR

(75) Inventors: Dirk Jan Holtslag, Diepenheim (NL); Henricus Johannes Maria Krabben, Harreveld (NL)

(73) Assignee: Honicel Nederland B.V., Zelhem (NL)

( * ) Notice: Subject to any disclaimer, the term of this patent is extended or adjusted under 35 U.S.C. 154(b) by 0 days.

(21) Appl. No.: 09/600,855

(22) PCT Filed: Jan. 22, 1999

(86) PCT No.: PCT/NL99/00040

§ 371 (c)(1), (2), (4) Date: Sep. 13, 2000

(87) PCT Pub. No.: WO99/37871

PCT Pub. Date: Jul. 29, 1999

(30) Foreign Application Priority Data

Jan. 23, 1998 (NL) ..... 1008118

(51) Int. Cl.[7] ..... B32B 31/22; B32B 31/20; E04C 2/36

(52) U.S. Cl. ..... 156/153; 156/258; 156/197; 52/783.17; 52/783.11; 428/117

(58) Field of Search ..... 156/153, 154, 156/200, 258, 265, 297, 298, 211, 197; 52/783.16, 783.15, 783.14, 783.11, 793.11, 783.17, 783.18, 793.1; 428/117, 118, 121

(56) References Cited

U.S. PATENT DOCUMENTS 2,348,703 A * 5/1944 Weir et al. ..... 428/121
3,483,070 A * 12/1969 Kennedy et al. ..... 428/118

FOREIGN PATENT DOCUMENTS

GB 2 277 709 11/1994

* cited by examiner

*Primary Examiner*—Richard Crispino
*Assistant Examiner*—George R. Koch, III
(74) *Attorney, Agent, or Firm*—Young & Thompson

(57) ABSTRACT

A method for the production of a core material (1) composed of strips (2) of preferably fibrous material for a sandwich panel, in which sandwich panel the width direction (7) of the strips (2) is coincident with the thickness direction of the panel and a cover layer (8, 9) is attached to each of the longitudinal edges of the strips (5, 6), comprises cutting each strip (2) from an even number of layers with the formation of, in each case, a longitudinal edge (5, 6) having a cut surface (11) which, viewed in cross section of the strip (2), runs at an incline between the two surfaces (15, 16) of the strip (2).

10 Claims, 1 Drawing Sheet

METHOD FOR THE PRODUCTION OF A SANDWICH PANEL AND CORE MATERIAL THEREFOR

The invention relates to the production of a core material for sandwich panels. Such a core material preferably consists of strips of fibrous material which are joined to one another at their surfaces with the joins offset turn and turn about In the expanded state, a pack of strips joined to one another in this way forms a honeycomb-like structure which combines low weight with high rigidity and strength in the finished panel.

A prior art method for producing such core material is disclosed in GB-A-2277709. This method for the production of a core material composed of strips of ( preferably fibrous material for a sandwich panel, in which sandwich panel the width direction of the strips is coincident with the thickness direction of the panel and a cover layer is attached to each of the longitudinal edges of the strips, comprises cutting each strip from an even number of layers with the formation of, in each case, a longitudinal edge having a cut surface.

In said finished panel the longitudinal edges of the strips are each attached to a cover sheet. The adhesion between the cover sheets and the strips of the core is obtained by means of an adhesive such as, for example, urea formaldehyde adhesive. In connection with keeping the total quantity of adhesive required as low as possible, in the case of cover sheets having a closed surface structure (such as metal or plastic) said adhesive is preferably applied to the longitudinal edges of the strips. Incidentally, in the case of cover sheets which consist of an open structure, such as fibrous material, the adhesive is applied to said cover sheets themselves.

In order to obtain adhesion of the desired strength, it is not only the quality of the adhesive that is important, but also the nature of the surfaces to be joined. The surface area of the longitudinal edges of the strips, which is determined by the cut surface which is the result of cutting off the strips from a sheet, is fairly small. Nevertheless, a certain strength of join can still be achieved because the adhesive forms beads close to the longitudinal edges on both surfaces of the strips, which beads have a beneficial effect on the join. The fact that the material of the strips is fibrous also contributes to the adhesion. The adhesive is able to penetrate into said fibrous material to some extent, as a result of which the strength of the adhesion increases.

In order to improve the absorbent capacity and the surface area of the longitudinal edges available for adhesion, the core material is fed between two rollers, which are optionally provided with a profile. Said rollers roughen the cut surfaces of the strips and as it were make said surfaces open and larger, so that a larger amount of adhesive can be absorbed and the adhesion can be improved.

The aim of the invention is to improve the production of such sandwich panels so that, on the one hand, the production process is simplified and, on the other hand, better adhesion between cover sheets and core material is obtained.

Said aim is achieved by means of providing the core material wherein the cut surface, viewed in cross-section of the strip, runs at an incline between the two surfaces of the strip.

With the method according to the invention, the strips which form the core are cut off from a sheet of starting material in such a way that an oblique cut surface is produced. As a consequence of such an oblique cut, the surface area of the cut surface is increased and specifically is increased by a factor of $1/\cos\alpha$, where $\alpha$ is the acute angle between the cut surface and the thickness direction of the strip.

Said increase in surface area yields a larger surface area of the core available for adhesion to the cover sheets, as a consequence of which the quality of the join is higher. The larger surface area is also able to absorb more adhesive.

The better adhesion is obtained on both longitudinal edges of the strips. Specifically, the strips are cut successively in a continuous process from an even number of sheets of starting material. The angles of the two longitudinal edges of a strip are therefore also complementary.

The adhesion of the honeycomb with obliquely cut longitudinal edges can be further improved by a treatment with, for example, rollers, optionally provided with a profile, as a result of which, just as in the case of conventional honeycomb, the cut surfaces are roughened.

According to the invention the angle of the cut surface can be between 20° and 70° with respect to the thickness direction of the strip. Preferably, said angle is approximately 45°.

The invention also relates to a method for the production of a panel from a core material and two cover layers, comprising the steps of production of a core material composed of strips of preferably fibrous material, as described above, application of an adhesive to the longitudinal edges of the strips of the core material and/or to the cover layers and pressing the core material and the cover layers onto one another.

Such panel is also disclosed in GB-A-2277709. According to the invention, during pressing the core material and the cover layers onto one another the longitudinal edges are deformed as a consequence of their inclined cut surface, which deformed a case material composed longitudinal edges provide an enlarged area of adhesion between the core material and the cover layers.

As already mentioned, the oblique shape of the longitudinal edges of the strips in the core leads to an increase in the surface available for adhesion. Said surface available for adhesion is further enlarged as a consequence of the deformation of the longitudinal edges on compressing the pack made up of core and cover sheets. This leads to a further improvement in the adhesion between core and cover sheets.

The invention also relates to a panel as produced according to the method described above.

The invention will now be explained in more detail with reference to an illustrative embodiment shown in the figures.

Figure 1:
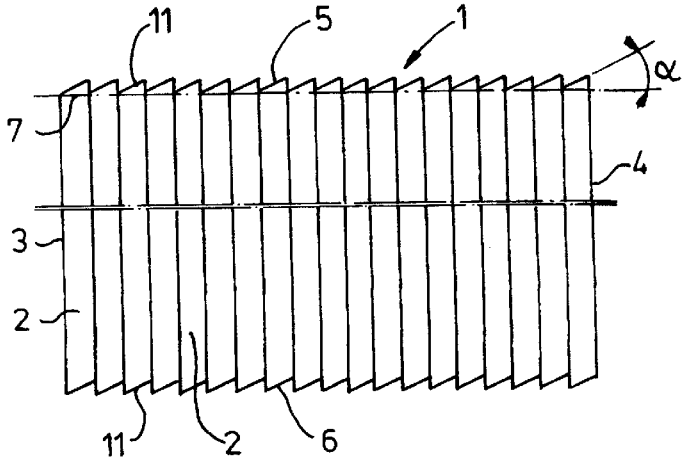
FIG. 1 shows a section of a core material, made up of strips, in the closed form, each strip consisting of an even number of layers.
Figure 2:
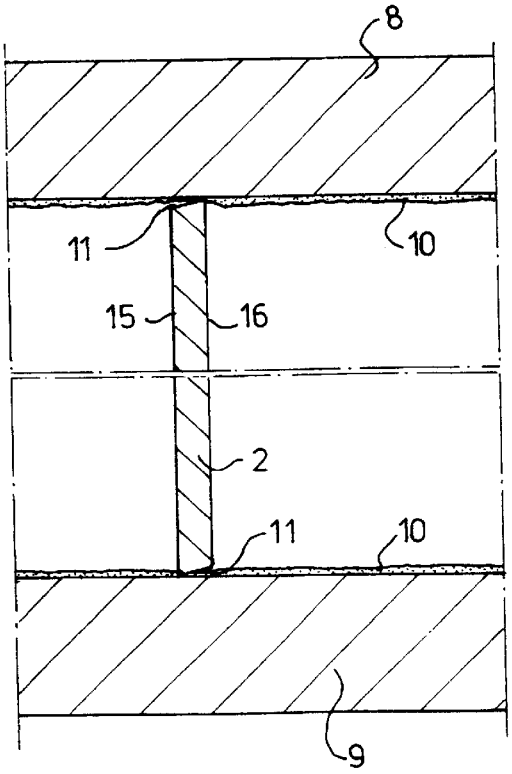
FIG. 2 shows the core material between two cover sheets before fixing to one another.

The core material 1 shown in FIG. 1 is made up of strips 2, consisting of an even number of layers, which are joined to one another, for example by gluing, at their surfaces 3, 4 facing one another with the joins offset turn and turn about. On expansion of the core material 1, a honeycomb structure is obtained as a consequence of said joins being offset turn and turn about. A honeycomb structure of this type for a core material made up of strips 2 is known and is not further shown.

The strips 2 are cut off obliquely at their longitudinal edges 5, 6. The angle $\alpha$ with respect to their thickness direction 7 can be between 20 and 70°. The angle $\alpha$ is preferably 45°.

Cover sheets 8, 9 are used to produce a panel from a core material 1. A layer 10 of adhesive is applied to those surfaces of the cover sheets 8, 9 which face one another. The cover sheets 8, 9 can consist of fibrous material, like the strips 2.

Figure 3:
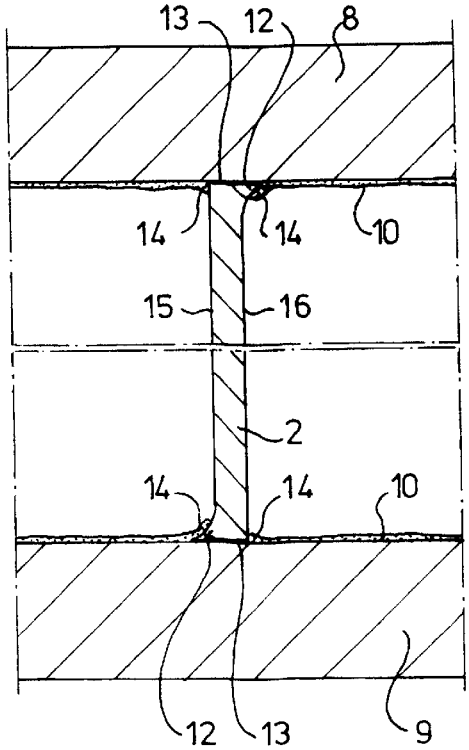
FIG. 3 shows a cross-section through a finished panel.

The pack made up of cover sheets 8, 9 and strips 2 is then pressed together, as a result of which the oblique cut surfaces 11 are pressed flat as is shown in FIG. 3.

On said pressing flat, a nose 12 is formed on each strip, as a result of which an enlarged area 13 for adhesion between each strip 2 and the cover sheets 8, 9 is in turn obtained.

Furthermore, a bead 14 of adhesive material is formed on both sides of the surface 13, available for adhesion, as a consequence of the adhesive being squeezed out, as a result of which the adhesion between the strips 2 and the cover sheets 8, 9 is further improved.

What is claimed is:

1. In a method for the production of a core material (1) composed of strips (2) of material for a sandwich panel in which a width direction of the strips (2) is coincident with a thickness direction of the panel and a cover layer (8, 9) is attached to each of longitudinal edges (5, 6) of the strips (2), comprising cutting each strip (2) from an even number of layers with the formation of, in each case, a longitudinal edge (5, 6) having a cut surface (11); the improvement wherein the cut surface (11), viewed in cross-section of the strip (2), runs at an incline between two major surfaces (15, 16) of the strip (2).

2. Method according to claim 1, comprising cutting each strip (2) with the formation of a cut surface (11) at an angle ($\alpha$) of between 20° and 70° with respect to a thickness direction (7) of the strip (2).

3. Method according to claim 1, comprising cutting each strip (2) with the formation of a cut surface (11) at an angle ($\alpha$) of between 30° and 60° with respect to a thickness direction (7) of the strip (2).

4. Method according to claim 1, comprising cutting each strip (2) with the formation of a cut surface (11) at an angle ($\alpha$) of between 40° and 50° with respect to a thickness direction (7) of the strip (2).

5. Method according to claim 1, comprising cutting each strip (2) with the formation of a cut surface (11) at an angle ($\alpha$) of 45°.

6. Method for the production of a panel from a core material (1) and two cover layers (8, 9), comprising the steps of production of a core material (1) composed of strips (2) of material, according to claim 1, application of an adhesive (10) between said longitudinal edges (5, 6) of the strips (2) of the core material (1) and the cover layers (8, 9) and pressing the core material (1) and the cover layers (8, 9) onto one another, whereby during pressing the core material (1) and the cover layers (8, 9) onto one another the longitudinal edges (5, 6) are deformed (12) as a consequence of their inclined cut surface (11), which deformed longitudinal edges (5, 6) provide an enlarged area (13) of adhesion between the core material (1) and the cover layers (8, 9).

7. Method according to claim 6, wherein the core material is roughened using rollers.

8. Panel produced according to the method of claim 6, comprising a core material (1) composed of strips (2) of material, said width direction of the strips being coincident with said thickness direction of said panel, and two said cover layers (8, 9) which are each by means of an adhesive (10) connected to the longitudinal edges (5, 6) of the strips (2), wherein said longitudinal edges have a deformed shape (12) as a consequence of their inclined cut surface (11), which deformed longitudinal edges (5, 6) provide an enlarged area (13) of adhesion between said core material (1) and said cover layers (8, 9).

9. A method according to claim 1, wherein said material is a fibrous material.

10. A panel according to claim 8, wherein said material is a fibrous material.

* * * * *